US010718496B2

(12) United States Patent
Premysler et al.

(10) Patent No.: US 10,718,496 B2
(45) Date of Patent: Jul. 21, 2020

(54) SWITCHGEAR CABINET LIGHTING UNIT HAVING AN ADJUSTABLE LIGHTING MEANS BOARD

(71) Applicant: RITTAL GMBH & CO. KG, Herborn (DE)

(72) Inventors: Ewgenij Premysler, Frankfurt am Main (DE); Kurt-Michael Schaffer, Eckental (DE); Marco Deusing, Herborn (DE); Matthias Müller, Dillenburg (DE); Christian Dietrich, Mittenaar-Offenbach (DE)

(73) Assignee: RITTAL GMBH & CO. KG, Herborn (DE)

( * ) Notice: Subject to any disclaimer, the term of this patent is extended or adjusted under 35 U.S.C. 154(b) by 27 days.

(21) Appl. No.: 16/082,379

(22) PCT Filed: Apr. 6, 2017

(86) PCT No.: PCT/DE2017/100274
§ 371 (c)(1),
(2) Date: Sep. 5, 2018

(87) PCT Pub. No.: WO2017/182032
PCT Pub. Date: Oct. 26, 2017

(65) Prior Publication Data

US 2019/0063725 A1 Feb. 28, 2019

(30) Foreign Application Priority Data

Apr. 18, 2016 (DE) ..... 10 2016 107 147

(51) Int. Cl.
*F21V 17/02* (2006.01)
*F21V 17/00* (2006.01)
(Continued)

(52) U.S. Cl.
CPC ..... *F21V 17/02* (2013.01); *F21S 4/28* (2016.01); *F21V 17/002* (2013.01);
(Continued)

(58) Field of Classification Search
CPC ..... F21V 17/02; F21V 17/002; F21V 19/003; F21V 23/006; F21V 23/06
See application file for complete search history.

(56) References Cited

U.S. PATENT DOCUMENTS 8,232,724 B2 7/2012 Mostoller et al.
9,955,601 B2 4/2018 Premysler et al.
(Continued)

FOREIGN PATENT DOCUMENTS

CN 105102878 A 11/2015
DE 202012009313 U1 11/2012
(Continued)

OTHER PUBLICATIONS

International Search Report (in English and German) and Written Opinion (in German) issued in PCT/DE2017/100274, dated Jul. 17, 2017; ISA/EP.
(Continued)

*Primary Examiner* — Anabel Ton
(74) *Attorney, Agent, or Firm* — Harness, Dickey & Pierce, P.L.C.

(57) ABSTRACT

The invention relates to a switch cabinet light for illuminating the interior of a switch cabinet, comprising a light-emitting circuit board that has at least a first and a second orientation relative to a translucent light cover of the switch cabinet light in order to vary the beam direction of the switch cabinet light, wherein a light-emitting side of the light-emitting circuit board faces toward a first wall section of the translucent light cover in a first orientation of the light-emitting circuit board and toward a second wall section of
(Continued)

the translucent light cover in a second orientation of the light-emitting circuit board.

13 Claims, 3 Drawing Sheets

(51) Int. Cl.

| | |
|---|---|
| ***F21V 19/00*** | (2006.01) |
| ***F21V 23/00*** | (2015.01) |
| ***F21S 4/28*** | (2016.01) |
| ***F21V 23/06*** | (2006.01) |
| *F21Y 115/10* | (2016.01) |
| *F21Y 103/10* | (2016.01) |

(52) U.S. Cl.
CPC ..... *F21V 19/003* (2013.01); *F21V 23/006* (2013.01); *F21V 23/06* (2013.01); *F21Y 2103/10* (2016.08); *F21Y 2115/10* (2016.08)

(56) References Cited

U.S. PATENT DOCUMENTS

| | | | | |
|---|---|---|---|---|
| 10,030,689 | B2 | 7/2018 | Thielmann et al. | |
| 2008/0285264 | A1 | 11/2008 | Whitehouse et al. | |
| 2009/0109670 | A1* | 4/2009 | Boyer | F16B 5/0258 362/234 |
| 2009/0296381 | A1 | 12/2009 | Dubord | |
| 2009/0310362 | A1 | 12/2009 | Weij | |
| 2010/0220478 | A1* | 9/2010 | Fields | B64F 1/20 362/237 |
| 2010/0271804 | A1 | 10/2010 | Levine | |
| 2011/0141723 | A1 | 6/2011 | Lai et al. | |
| 2012/0257374 | A1* | 10/2012 | Daniel | F21K 9/90 362/84 |
| 2015/0062919 | A1* | 3/2015 | Teodecki | F21S 41/29 362/311.02 |
| 2015/0124440 | A1* | 5/2015 | Janjua | F21S 8/02 362/223 |
| 2016/0245462 | A1* | 8/2016 | Demuynck | F21V 19/003 |
| 2017/0064848 | A1 | 3/2017 | Premysler et al. | |
| 2017/0074312 | A1 | 3/2017 | Thielmann et al. | |
| 2017/0265320 | A1 | 9/2017 | Muller | |
| 2018/0320837 | A1* | 11/2018 | Romano | F21V 29/763 |

FOREIGN PATENT DOCUMENTS

| | | | |
|---|---|---|---|
| DE | 102011051034 | A1 | 12/2012 |
| DE | 102011122204 | B3 | 3/2013 |
| JP | 2014-225480 | A | 12/2014 |
| KR | 101111531 | B1 | 2/2012 |
| WO | WO-2011-087017 | A1 | 7/2011 |
| WO | WO-2015062889 | A1 | 5/2015 |

OTHER PUBLICATIONS

Korean Office Action for Application No. 10-2018-7029949, dated Sep. 23, 2019 (9 pages).
Chinese Office Action for Application No. 201780012508.5, dated Oct. 8, 2019 (8 pages).

* cited by examiner

SWITCHGEAR CABINET LIGHTING UNIT HAVING AN ADJUSTABLE LIGHTING MEANS BOARD

CROSS-REFERENCE TO RELATED APPLICATIONS

This application is a 371 U.S. National Stage of International Application No. PCT/DE2017/100274, filed on Apr. 6, 2017, which claims priority to German Application No. 10 2016 107 147.1, filed on Apr. 18, 2016. The entire disclosures of the above applications are incorporated herein by reference.

FIELD

The invention starts from a switch cabinet light for illuminating the interior of a switch cabinet, with the switch cabinet light having a light-emitting circuit board that can assume at least a first and a second orientation relative to a translucent light cover of the switch cabinet light in order to vary the beam direction of the switch cabinet light. Such a switch cabinet light is known, for example, from KR 101111531 B1.

BACKGROUND

This section provides background information related to the present disclosure which is not necessarily prior art.

DE 20 2012 009 313 U1 describes a switch cabinet light with an elongated, cylindrical light source that is guided between end-side mounting bases, each with a receptacle for the light source. The light source is mounted in the mounting bases so as to swivel about its longitudinal axis, for which purpose a cylindrical receptacle is provided in each of the mounting bases whose diameter is matched to the width of the light source.

Switch cabinet lights with adjustable light sources have the advantage that they can be adapted to the given conditions for optimal illumination of the cabinet interior depending on the application and required mounting position on the interior of a cabinet. The switch cabinet lights should also be designed, insofar as possible, so as not to radiate outward from the inside of the switch cabinet in order to minimize the glare angle of the switch cabinet light. Switch cabinet lights with adjustable reflector are also known from the prior art in addition to switch cabinet lights in which the light source is adjustable.

The switch cabinet lights that are known from the prior art have the drawback that the adjustability is achieved only using relatively complex technical adjustment mechanisms. Accordingly, the switch cabinet lights that are known from the prior art are elaborate and therefore cost-intensive to manufacture.

SUMMARY

This section provides a general summary of the disclosure, and is not a comprehensive disclosure of its full scope or all of its features.

It is therefore the aspect of the invention to provide a switch cabinet light of the type described at the outset in which the adjustability of the beam direction of the light source is achieved with the aid of simple technical means.

Accordingly, a provision is made that the switch cabinet light has a light-emitting circuit board with a light-emitting side that faces toward a first wall section of the translucent light cover in a first orientation of the light-emitting circuit board and toward a second wall section of the translucent light cover in a second orientation of the light-emitting circuit board.

The light-emitting circuit board can be configured such that it can be manually adjusted back and forth between the first and second orientations, for example. For example, the light-emitting circuit board can be embodied in the manner of a plug-in printed circuit board with electrically conductive plug contacts that can be received in a plug-in receptacle, such as a groove, of the switch cabinet light in two optional positions that are rotated in relation to one another at an angle, particularly in two positions that are rotated by 180° in relation to one another. The light cover can be a U-shaped light cover with two parallel spaced-apart transparent side walls in relation to which the light-emitting circuit board, in each of its two positions that are rotated by 180° in relation to one another, extends in parallel and thus turns its light source, such as LEDs or OLEDs, toward a first of the two side walls and toward a second of the two side walls, respectively, in the two positions that are rotated by 180° in relation to one another. Accordingly, the switch cabinet light has two mutually offset beam directions in the two orientations of the light-emitting circuit board that are rotated by 180° in relation to one another. The procedure for plugging the light-emitting circuit board in can be carried out completely without tools.

In order to enable the light-emitting circuit board to be easily moved, the light cover can be connected to a lamp base body of the switch cabinet light so as to be detachable without tools, in which case, when the light cover is connected to the lamp base body, the light-emitting circuit board is held by the light cover in a plug-in receptacle of the lamp base body in which the light-emitting circuit board is aligned.

The translucent light cover can further comprise a supporting structure on the inside on an end face or upper side that faces toward the light-emitting circuit board and has a groove-shaped receptacle for a longitudinal edge of the light-emitting circuit board in which the light-emitting circuit board is received and supported when the light cover is placed onto the lamp base body.

The plug-in receptacle of the lamp base body and the groove-shaped receptacle of the light cover can be aligned so as to face each other, and each can have an insertion chamfer in order to facilitate the precise alignment of the light cover through placement of the light cover on the lamp base body.

Moreover, the light-emitting circuit board can be a substantially rectangular printed circuit board with a plurality of light sources such as LEDs or OLEDs that are arranged on one side, in which a first of the two longitudinal edges of the printed circuit board can be received in the plug-in receptacle of the lamp base body and, when the lamp base body is connected to the light cover, a second of its two longitudinal edges can be received in the groove-shaped receptacle of the light cover.

If the light-emitting circuit board is embodied in the manner of a printed circuit board, then a provision can be made that the light sources are arranged on one of the opposite sides of the printed circuit board and no light sources are arranged on the other opposite side of the printed circuit board. Alternatively, the opposite sides can have different light sources that differ in their color characteristics or radiation intensity, for example, in which case the different light sources can be actuated separately on the opposite sides of the printed circuit board in order to achieve a desired light beam direction and light quality depending on the orientation of the light-emitting circuit board and the actuated light sources.

If the light-emitting circuit board is a printed circuit board with light sources on one of its two opposite sides, then a provision can be made that the light sources face toward the first wall section of the translucent light cover in the first orientation of the printed circuit board and toward the second wall section of the translucent light cover in the second orientation of the printed circuit board. For example, the light cover can have a U-shape in cross section perpendicular to the longitudinal direction, with two parallel sides that are connected by a side that is arranged perpendicular thereto, so that the light source faces toward a respective side of the U-shaped light cover in each of the two orientations.

With any other design of the light cover as well in which the light cover has two parallel, spaced-apart translucent wall sections, the printed circuit board can be aligned parallel to the wall sections in its two orientations, in which case the light sources face toward a first of the two translucent wall sections in the first orientation of the printed circuit board and toward a second of the two translucent wall sections in the second orientation of the printed circuit board.

The switch cabinet light can further comprise control electronics for the light-emitting circuit board that are contacted via a detachable multipolar, particularly bipolar contact to the light-emitting circuit board in the two orientations of the light-emitting circuit board. This manner of contacting is particularly expedient if the light-emitting circuit board is embodied in the manner of a breadboard that is received in a lamp base body-side plug-in receptacle.

The detachable bipolar contact can have a pair of spring contact pins on the control electronics side and three spring contact tabs on the light-emitting circuit board side, in which case the spring contact pins contact a first pair of spring contact tabs in the first orientation of the light-emitting circuit board and the spring contact pins contact a second pair of spring contact tabs in the second orientation of the light-emitting circuit board. In this case, the two pairs of spring contact tabs have a common spring contact tab and a different spring contact tab. If the light-emitting circuit board is embodied as a substantially rectangular printed circuit board that can be received in the lamp base body-side plug via its opposite longitudinal edges in two positions that are mutually rotated by 180°, then if the abovementioned spring contact with two spring contact pins and two pairs of spring contact tabs is used, the common spring contact tab should be centrally located in the connecting direction between the longitudinal edges of the printed circuit board, while the two remaining spring contact tabs should be arranged symmetrically above and below the center spring contact tab at a distance therefrom under the mutual spacing of the spring contact pins.

Particularly if the board has spring contact tabs on each of its two opposite end faces for contacting the control electronics, the board can also be fixed on the light base body in two positions that are rotated by 180° about an axis of rotation that extends perpendicularly through the two longitudinal edges of the light-emitting circuit board.

In order to ensure sufficient cooling of the light-emitting circuit board, a provision can be made that the plug-in receptacle is formed in the lamp base body as a groove that extends along the longitudinal direction of the lamp base body, in which case the lamp base body has a heat sink that is integrally formed against the groove, whereby the heat sink is thermally coupled with the groove. A light source on the light-emitting circuit board can be thermally coupled via a thermal conductor with a longitudinal edge of the light-emitting circuit board via which the light-emitting circuit board is inserted into the plug-in receptacle and/or groove of the lamp base body.

However, it is also conceivable for the light-emitting circuit board and the light cover to form a unit, for example through (possibly detachable) interconnection. In this case, in order to adjust the light beam direction of the light, the unit comprising the light-emitting circuit board and the light cover can be detached from the lamp base body in a single work step and placed back onto the lamp base body 7 so as to be rotated by 180°. The unit is rotated about an axis of rotation that extends perpendicular to the two longitudinal edges of the board through the longitudinal edges.

According to another aspect, a switch cabinet light has a light housing in which control electronics for a light-emitting circuit board of the light are held and to one side of which a lamp base body that holds the light-emitting circuit board is optionally detachably fastened via one of its two longitudinal ends, with the light-emitting circuit board, the lamp base body, and a light cover covering the light-emitting circuit board that is mounted on the lamp base body forming a unit or being integrally formed, so that the entire unit of light-emitting circuit board, lamp base body, and light cover are fixed in two positions that are rotated by 180° about an axis of rotation on the light housing, with the axis of rotation extending perpendicular to the two longitudinal edges of the board through the longitudinal edges, and with the control electronics contacting the board in both positions that are rotated by 180° relative to one another.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Additional details of the invention will be explained with reference to the following figures.

DETAILED DESCRIPTION

Example embodiments will now be described more fully with reference to the accompanying drawings.

Figure 1:
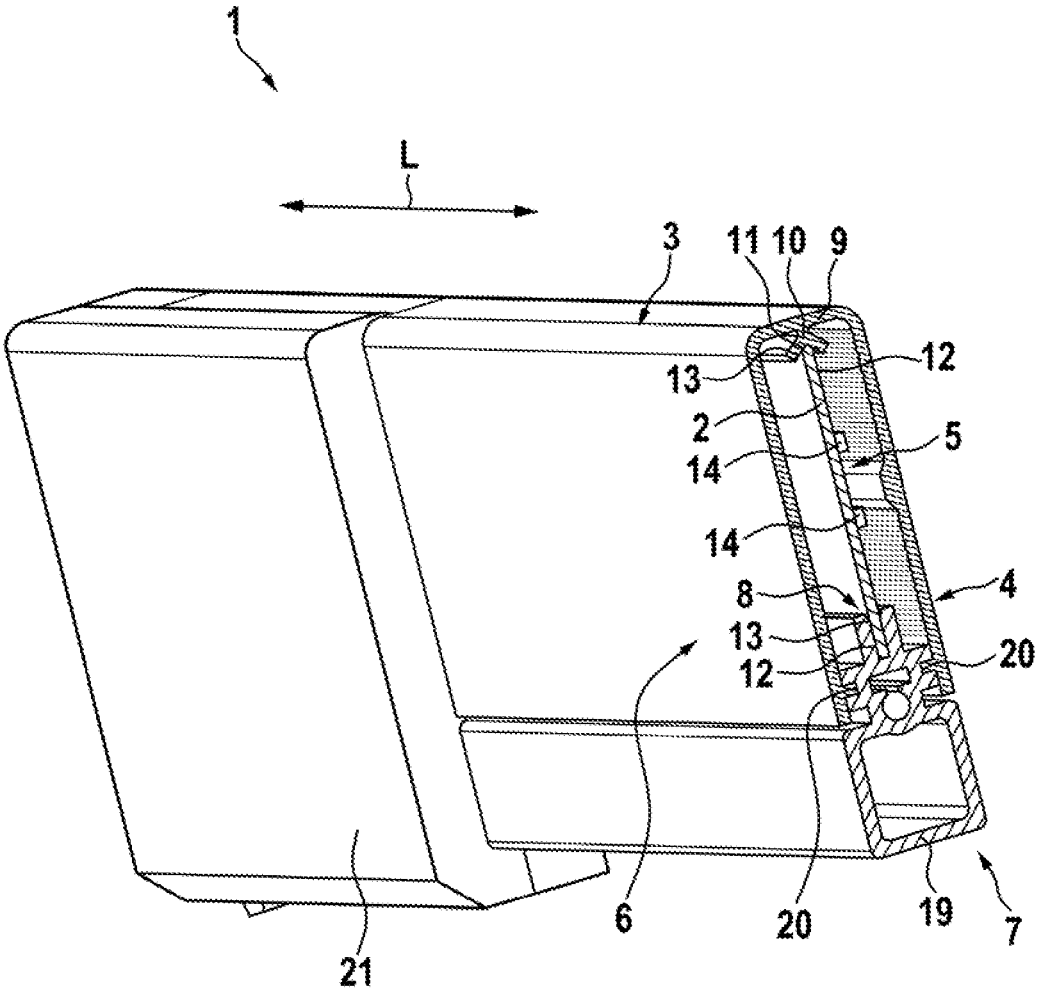
FIG. 1 shows an embodiment of the switch cabinet light in cross section perpendicular to the longitudinal direction.

FIG. 1 shows an embodiment of the switch cabinet light 1 according to the invention that is cut perpendicular to the longitudinal direction through the light cover 3, the light-emitting circuit board 2, and the lamp base body 7. At its end, the switch cabinet light 1 has a lamp housing 21 in which the control electronics 15 of the light-emitting circuit board 2 can be accommodated (cf. FIG. 2).

Besides the lamp housing 21 with the control electronics accommodated therein, the switch cabinet light 1 thus consists substantially of the lamp base body 7, the light-emitting circuit board 2 that is plugged onto the lamp base body 7, and the translucent light cover 3 that encloses the light-emitting circuit board 2. It can be seen that the lamp base body 7, the light-emitting circuit board 2, and the light cover 3 cooperate precisely in such a way that, in the position of the light cover 3 that is shown in FIG. 1, in which it is fastened to the lamp base body 7 by means of two tongue-and-groove connections 20, the light-emitting circuit board 2 extends right between a plug-in receptacle 8 of the lamp body 7 and an opposing support structure 10 on the inner surface of the end face 9 of the light cover 3. The end face 9 just connects the opposing wall sections 4 that extend parallel to each other, so that the light cover 3 is substantially U-shaped in the cross section shown.

In order to form the tongue-and-groove connection 20, the lamp base body 7 has on its opposite longitudinal sides a groove in which corresponding projections engage on the mutually facing inner sides of the wall sections 4, 6. The supporting structure 10 that is embodied on the end face 9 forms a groove-shaped receptacle 11 for a longitudinal edge 12 of the light-emitting circuit board 2. The printed circuit board 2 is inserted into the plug-in receptacle 8 of the lamp base body 7 via an opposite longitudinal edge 12. When the light cover 3 has been removed and the light-emitting circuit board 2 has already been pre-positioned, in order to facilitate the placement of the light cover 3 onto the lamp base body 7 and thus the alignment of the light-emitting circuit board 2 with respect to the plug-in receptacle 8 and the groove-shaped receptacle 11, the groove-shaped receptacle 11 and/or the plug-in receptacle 8 each have an insertion chamfer 13.

It can also be seen that at least one of the two parallel wall sections 4, 6 has a structure on its inner side facing toward the light source 14 on the light-emitting side 5 of the light-emitting circuit board 2. This is designed in the manner of a Fresnel lens, which imparts an improved light emission characteristic to the switch cabinet light 1. The wall sections 4, 6 can have identical or differing Fresnel structures, so that the radiation characteristic of the light can be varied through the selection of the wall section 4, 6 that faces toward the light sources 14.

Figure 2:
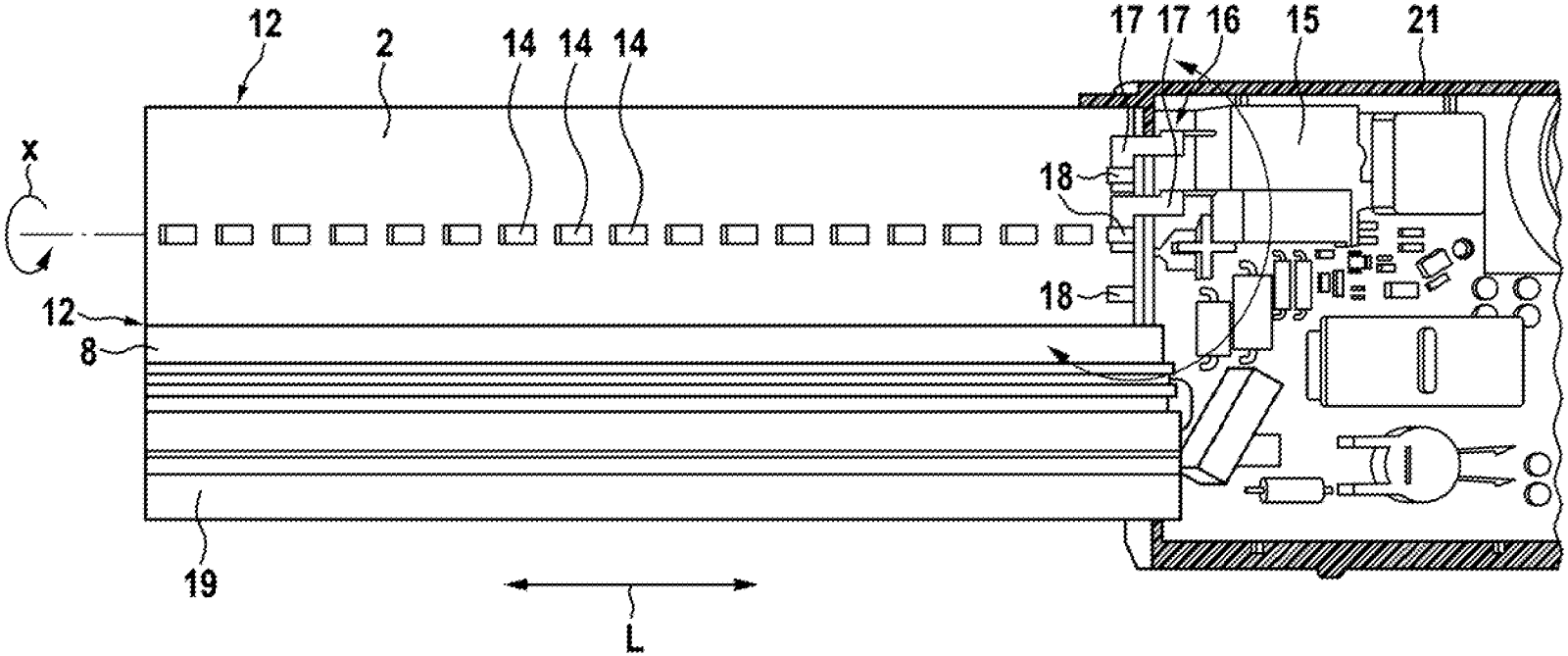
FIG. 2 shows another embodiment of the switch cabinet light with cut-out lamp housing and removed light cover.

FIG. 2 shows that the printed circuit board 2 can have a plurality of light sources 14 that are distributed in the longitudinal direction L of the switch cabinet light 1 and light-emitting circuit board 2. These can be LEDs or OLEDs. In principle, however, all other light-generating means are suitable that can be arranged and controlled on a printed circuit board or board 2 in the manner shown. The light-emitting circuit board 2 has on its end facing toward the lamp housing 21 three spring contact tabs 18, the upper and middle one of which in the illustration are respectively contacted by a spring contact pin 17 of the control electronics 15. The spring contact pins 17 and the spring contact tabs 18 thus form a contact between the light-emitting circuit board 2 and the control electronics 15.

When viewed together, the embodiments shown in FIGS. 1 and 2 illustrate that, in two positions that are rotated by 180° relative to one another, the light-emitting circuit board 2 can be inserted via its opposite longitudinal edges 12 into the plug-in receptacle 8 of the lamp base body 7 while contacting the control electronics 15. As can be seen, if the light-emitting circuit board 2 shown in FIG. 2 is rotated by 180° so that the two longitudinal edges 12 of the light-emitting circuit board 2 exchange positions, the two spring contact pins 17 instead of the two upper spring contact tabs 18 in the illustration contact the two lower spring contact tabs 18 in the illustration, which would understandably assume the position of the two upper spring contact tabs 18 in the illustration after the light-emitting circuit board 2 is rotated by 180° and are thus exactly pre-positioned to contact the spring contact pins 17. For this purpose, the spring contact tabs 18 should be arranged equidistant in the vertical connecting direction between the longitudinal edges 12, whereas, beyond that, the middle contact tab 18 should be arranged centrally between the two longitudinal edges or on an axis of rotation x of the light-emitting circuit board 2.

Particularly if the board 2 has spring contact tabs 18 on each of its two opposite end faces for contacting the control electronics 15, the board 2 can also be fixed on the light base body in two positions that are rotated by 180° about another axis of rotation (y) that extends perpendicularly through the two longitudinal edges 12 of the light-emitting circuit board 2.

Figure 3:
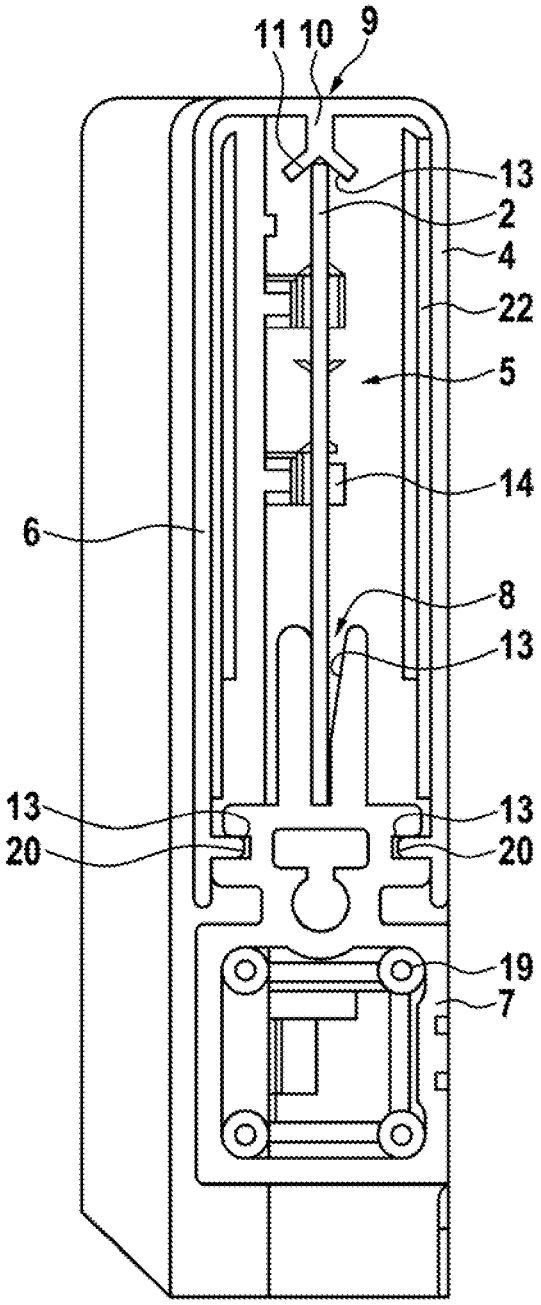
FIG. 3 shows another embodiment of the switch cabinet light in cross section perpendicular to the longitudinal direction.

The cooperation of the light-emitting circuit board 2, the light cover 3, and the lamp base body 7 is shown once again in detail in FIG. 3. As has already been described with reference to FIG. 1, both the plug-in receptacle 8 and the groove-shaped receptacle 11 of the support structure 10 have an insertion chamfer 13 in order to facilitate the insertion of the light-emitting circuit board 2 into the plug-in receptacle 8 and the groove-shaped receptacle 11 during placement of the light cover 3 onto the lamp base body 7. Likewise, the tongue-and-groove connection 20 on the opposite longitudinal sides of the lamp base body 7 and on the mutually facing inner sides of the parallel wall sections 4, 6 of the light cover 3 have an insertion chamfer 13, which serves both to facilitate the placement of the cover 3 onto the lamp base body 7 and to provide a bias with which the light-emitting circuit board 2 is held in the plug-in receptacle 8 and the groove-shaped receptacle 11 when the light cover 3 is placed onto the lamp base body 7.

At the same time, the lamp base body 7 forms a heat sink for the light sources 14, such as LEDs or OLEDs, that are arranged on the light-emitting circuit board 2. For this purpose, the light sources 14 are thermally coupled by means of thermal conductors, such as metal strips, with the plug-in receptacle 8, so that residual heat arising at the light sources 14 can be discharged via the thermal conductors and the plug-in receptacle 8 to the lamp base body 7. The lamp base body 7 has a heat capacity that is as high as possible. The lamp base body 7 is preferably made of a thermally conductive material such as metal or a suitable engineering plastic.

Finally, it can be seen that the light-emitting circuit board 2 has light sources 14 on only one of its two opposite sides, so that the light-emitting circuit board 2 has one light-emitting side 5 and one opposite side from which no light is emitted. By virtue of the fact that the light-emitting circuit board 2 is inserted with its respective opposite longitudinal edge 12 into the plug-in receptacle 8 so as to be offset by 180°, the orientation of the light-emitting side 5 of the light-emitting circuit board 2 changes as well, so that it faces once toward the first wall section 4 and once toward the second wall section 6.

In order to further improve the light emission behavior of the switch cabinet light 1, a provision can be made that a reflector 22 is arranged on that wall section of the two wall sections 4, 6 that is facing away from the light-emitting side 5 of the light-emitting circuit board 2. Owing to the symmetrical tongue-and-groove connections 20 on the opposite longitudinal sides of the lamp base body 7, the light cover 3 can be fixed in a position on the lamp base body 7 that is rotated by 180° when the light-emitting circuit board 2 is rotated by 180°. The reflector 22 then also changes position on the inside of the first wall section 4 in accordance with the light sources 14, so that it again faces toward the side of the light-emitting circuit board 2 that is facing away from the light-emitting side 5 of the light-emitting circuit board 2.

However, it is also conceivable for the light-emitting circuit board 2 and the light cover 3 to form a unit, for example through (possibly detachable) interconnection. In this case, in order to adjust the light beam direction of the light, the unit comprising the light-emitting circuit board 2 and the light cover 3 can then be detached from the lamp base body 7 in a single work step and placed back onto the lamp base body 7 so as to be rotated by 180°. The unit of light-emitting circuit board 2 and light cover 3 is rotated about another axis of rotation (y) that extends perpendicular to the two longitudinal edges 12 of the board 2 through the longitudinal edges 12 (cf. FIG. 2).

Due to the biasing force exerted by the interaction of plug-in receptacle 8 and supporting structure 10 on the light-emitting circuit board 2 with which the light-emitting circuit board 2 is pressed into the receptacle 8, the thermal contact between the light-emitting circuit board 2 and the plug-in receptacle 8 and, accordingly, with the lamp base body 7 is improved, thereby promoting or facilitating the discharging of the residual heat generated by the light sources 14.

The features of the invention that are disclosed in the foregoing description, in the drawings, and in the claims may be essential to the implementation of the invention both individually and in any combination with one another.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A switch cabinet light for illuminating the interior of a switch cabinet, comprising a light-emitting circuit board that has at least a first and a second orientation relative to a translucent light cover of the switch cabinet light in order to vary the beam direction of the switch cabinet light, wherein a light-emitting side of the light-emitting circuit board faces toward a first wall section of the translucent light cover in a first orientation of the light-emitting circuit board and toward a second wall section of the translucent light cover in a second orientation of the light-emitting circuit board, wherein, when the light cover is in place, the light-emitting circuit board extends between a plug-in receptacle of a lamp base body and an opposing supporting structure on an inner side of an end face of the lamp cover, wherein the light cover has a U-shape in cross section perpendicular to the longitudinal direction and the two wall sections are oppositely situated and extend parallel to one other and are interconnected by the end face, and wherein the light cover is fastened to the lamp base body by means of two tongue-and-groove connections.

2. The switch cabinet light as set forth in claim 1, wherein the translucent light cover is detachably connected to the lamp base body of the switch cabinet light and, when the light cover is connected to the lamp base body, the light-emitting circuit board is held by the light cover in the plug-in receptacle of the lamp base body.

3. The switch cabinet light as set forth in claim 2, wherein the translucent light cover has a supporting structure on the inside on an end face that faces toward the light-emitting circuit board and has a groove-shaped receptacle for a longitudinal edge of the light-emitting circuit board in which the light-emitting circuit board is received and supported when the light cover is placed onto the lamp base body.

4. The switch cabinet light as set forth in claim 2, wherein the plug-in receptacle of the lamp base body and the groove-shaped receptacle of the light cover are aligned so as to face each other, with each having an insertion chamfer.

5. The switch cabinet light as set forth in claim 4, wherein the light-emitting circuit board is a substantially rectangular printed circuit board with a plurality of light sources that are arranged on one side thereof, with a first of the two longitudinal edges of the printed circuit board being received in the plug-in receptacle of the lamp base body and, when the lamp base body is connected to the light cover, a second of its two longitudinal edges is received in the groove-shaped receptacle of the light cover.

6. The switch cabinet light as set forth in claim 1, wherein the light-emitting circuit board is a printed circuit board with light sources on one of two opposite sides of the printed circuit board, with the light sources facing toward the first wall portion of the translucent light cover in the first orientation of the printed circuit board and toward the second wall portion of the translucent light cover in the second orientation of the printed circuit board.

7. The switch cabinet light as set forth in claim 6, wherein the light cover has two parallel, spaced-apart translucent wall sections, wherein the printed circuit board is aligned parallel to the wall sections in its two orientations, and wherein the light sources face toward a first of the two translucent wall sections in the first orientation of the printed circuit board and toward a second of the two translucent wall sections in the second orientation of the printed circuit board.

8. The switch cabinet light as set forth in claim 1, further comprising control electronics for the light-emitting circuit board that are contacted via a detachable bipolar contact with the light-emitting circuit board in both orientations of the light-emitting circuit board.

9. The switch cabinet light as set forth in claim 8, wherein the contact has a pair of control electronics-side spring contact pins and three light-emitting circuit board-side spring contact tabs, wherein the spring contact pins contact a first pair of spring contact tabs in the first orientation of the light emitting circuit board, wherein the spring contact pins contact a second pair of spring contact tabs in the second orientation of the light emitting circuit board, and wherein the two pairs of spring contact tabs have a common spring contact tab and a different spring contact tab.

10. The switch cabinet light as set forth in claim 1, wherein the plug receptacle in the lamp base body is embodied as a groove that extends along the longitudinal direction of the lamp base body, wherein the lamp base body has a heat sink that is integrally formed against the groove and is thermally coupled therewith, and wherein a light source on the light emitting circuit board is thermally coupled via a thermal conductor with a longitudinal edge of the light-emitting circuit board via which the light-emitting circuit board is inserted into the groove of the lamp base body.

11. The switch cabinet light as set forth in claim 1, wherein the board has spring contact tabs on each of its two opposite end faces for contacting the control electronics, so that the board can also be fixed on the light base body in two positions that are rotated by 180° about an axis of rotation that extends perpendicularly through the two longitudinal edges of the light-emitting circuit board.

12. The switch cabinet light as set forth in claim 1, wherein the light-emitting circuit board and the light cover form a unit, for example through (possibly detachable) interconnection, so that, in order to adjust the light beam direction of the switch cabinet light, the unit comprising light-emitting circuit board and light cover can be detached from the lamp base body in a single work step and placed back onto the lamp base body so as to be rotated by 180°.

13. A switch cabinet light, with a light housing in which control electronics for a light-emitting circuit board of the light are held and to one side of which a lamp base body that holds the light-emitting circuit board is optionally detachably fastened via one of its two longitudinal ends, with the light-emitting circuit board, the lamp base body, and a light cover covering the light-emitting circuit board that is mounted on the lamp base body forming a unit or being integrally formed, so that the entire unit of light-emitting circuit board, lamp base body, and light cover are fixed in two positions that are rotated by 180° about an axis of rotation on the light housing, with the axis of rotation extending perpendicular to the two longitudinal edges of the board through the longitudinal edges, and with the control electronics contacting the board in both positions that are rotated by 180° relative to one another, wherein, when the light cover is in place, the light-emitting circuit board extends between a plug-in receptacle of a lamp base body and an opposing supporting structure on an inner side of an end face of the lamp cover, wherein the light cover has a U-shape in cross section perpendicular to the longitudinal direction and the two wall sections are oppositely situated and extend parallel to one other and are interconnected by the end face, and wherein the light cover is fastened to the lamp base body by means of two tongue-and-groove connections.

* * * * *